United States Patent [19]

Salani

[11] Patent Number: 4,720,207

[45] Date of Patent: Jan. 19, 1988

[54] SEGMENTED ROTOR

[75] Inventor: C. Ranjan Salani, Springfield, Ohio

[73] Assignee: Koehring Company, Milwaukee, Wis.

[21] Appl. No.: 901,876

[22] Filed: Aug. 29, 1986

[51] Int. Cl.[4] ..... E01C 23/12; E01C 19/26

[52] U.S. Cl. ..... 404/90; 404/132; 299/39; 29/123; 29/124; 29/125; 172/123

[58] Field of Search ..... 404/117, 121–123, 404/132, 90, 91; 299/39, 40; 172/535, 568, 556, 122, 123; 37/189, 190; 29/123–125

[56] References Cited

U.S. PATENT DOCUMENTS

| | | | |
|---|---|---|---|
| 2,635,403 | 4/1953 | Gandrud | 55/24 |
| 2,905,456 | 9/1959 | Rafferty et al. | 262/9 |
| 3,306,669 | 2/1967 | Christensen et al. | 299/89 |
| 3,375,764 | 4/1968 | Petersen | 172/123 X |
| 4,006,936 | 2/1977 | Crabiel | 299/39 |
| 4,040,158 | 8/1977 | Payne | 29/123 |
| 4,040,668 | 8/1977 | Fairweather et al. | 299/39 |
| 4,068,688 | 1/1978 | Benson | 299/89 |
| 4,069,605 | 1/1978 | Satterwhite | 37/190 |
| 4,175,886 | 11/1979 | Moench et al. | 404/90 |
| 4,186,968 | 2/1980 | Barton | 299/39 |
| 4,280,565 | 7/1981 | van der Lely | 172/123 X |
| 4,386,661 | 6/1983 | McCanse et al. | 172/123 X |
| 4,420,048 | 12/1983 | Peterson | 172/568 |
| 4,421,177 | 12/1983 | Schlapman et al. | 172/123 X |
| 4,473,320 | 9/1984 | Register | 404/91 |

*Primary Examiner*—James A. Leppink
*Assistant Examiner*—John F. Latchford
*Attorney, Agent, or Firm*—Lane & Aitken

[57] ABSTRACT

A road working machine for cutting into a road surface includes a power driven, cutting tooth carrying rotor comprising a plurality of rotor segments removably attached to a shaft to vary rotor width. Each of the segments includes a plurality of subsegments attached to one another and to the rotor by threaded fasteners. Rings supporting a higher concentration of cutting teeth angled toward the ends of the rotor can be secured to the endmost rotor segments for edge cutting. A cover for the rotor includes an adjustable baffle which may be secured at any of a plurality of positions in the cover to lie adjacent an end segment of the rotor in use regardless of the rotor width.

22 Claims, 11 Drawing Figures

SEGMENTED ROTOR

BACKGROUND OF THE INVENTION

The present invention relates to machines for cutting road surfaces for various purposes and, more particularly, to a power driven cutting tooth rotor comprised of segments which can be removed and replaced without disturbing other parts of the machine.

In devices, such as road planers, having power driven rotary drums, or rotors, fitted with cutting teeth for cutting a road surface, it is often desirable to cut swaths of varying widths. A conventional rotor width for working the main part of a roadway is about 6½ feet, which is well suited for preparing the road for paving. However, there are many cutting jobs for which a conventional width rotor is too big. For example, in cases where only the shoulder of a road needs to be cut, a rotor of about 4 feet in width is more desirable, since a rotor of conventional width cuts too wide a path. Even narrower widths of rotors are useful for cutting strips to install or repair sewer lines and cables, and to perform other tasks.

In order to satisfy some of the needs just described, prior art machinery has been devised which allows for the removal of a rotary drum of a first width in favor of a rotary drum of a second width. However, removal of the entire rotary drum and replacement by another is a difficult job, since it involves removal of not only the rotary drum, but also the power driven shaft which supports the rotary drum on the machine. Removal of the shaft typically requires disconnecting it from the drive mechanism, as well as removing it from bearings, bearing housings, shaft seals, etc.

Such a shaft removal is required not only where a rotary drum is being removed for replacement by a drum of a different width, but also where a rotary drum is being removed for repair. Frequent removal for repair is necessary because the cutting teeth mounted on the rotors often become worn or damaged and require replacement. Where the cutting teeth are permanently affixed to the rotary drum, either the drum must be removed and replaced, or the individual teeth must be cut from the drum with a cutting torch and replacement teeth must be welded onto the drum. Such a tooth removal and replacement process is time consuming and results in long periods of down time for the machinery.

SUMMARY OF THE INVENTION

By the present invention, a road planer or other machine for cutting a road surface is provided with a tooth-carrying rotary drum comprising a plurality of segments, one or more of which can be removed for cutting swaths of varying width without requiring removal of the rotor shaft or other parts of the road planer.

In order to accomplish such removal, each rotor segment is made up of a plurality of subsegments, such as two halves, which are removably secured to each other and to mounting flanges fixed to the rotor shaft. Each of the rotor segments is attached to adjacent rotor segments to define an integral rotor. One end rotor segment, a base rotor segment, is always present, so that the road planer can cut right up to the edge of a road, for example, right up to a curb, and can always be guided precisely along the edge of the road regardless of the width of the cut to be made. End rings carrying cutting teeth canted toward the ends of the rotor can be provided at the ends of the segmented rotor for cutting along the edge of the swath to provide clearance for the ends of the rotor and thereby to avoid excessive wear on rotor end surfaces. Protection rings are secured to any of the mounting flanges on the rotor shaft which are not used during a particular operation in order to protect the flanges from wear. An adjustable rotor baffle is provided within a hood covering the rotor and is securable in different positions along the axis of the rotor, so that the baffle can be adjacent to the distal end of rotors of varying widths in order to confine the cut material to within the width of the rotor and to protect people around the machine from flying particles. When cut material is allowed to fall along a path wider than the cut, it is difficult to see the actual width of the cut and to determine where to begin the next cut or perform some other operation.

In one embodiment of the segmented rotor according to the present invention, a joint defined between the subsegments of each rotor segment is offset in a circumferential direction from the joints of adjacent rotor segments in order to provide the rotor with increased strength and rigidity. Due to the pattern of cutting teeth on each subsegment, the staggering of joints results in fewer cutting teeth engaging the ground at any given time, since the positioning of the teeth on at least most of the rotor subsegments is identical and, with the offsetting of the joint of each segment from the joints of adjacent segments, the teeth of each segment are offset with respect to the teeth of adjacent segments. Fewer teeth engaging the ground at a given time permits each tooth to cut the ground with a greater force for a given amount of power supplied to the rotor.

In another embodiment of the invention, the subsegments of the rotor are semicircular tine plates which are held together by connecting bars. The tine plates at the ends of the rotor have a heavier concentration of cutting teeth than the other tine plates, and the teeth on the end tine plates are angled toward the end of the rotor shaft at which their respective plates are mounted for edge cutting purposes.

DETAILED DESCRIPTION OF THE PREFERRED EMBODIMENTS

Figure 1:
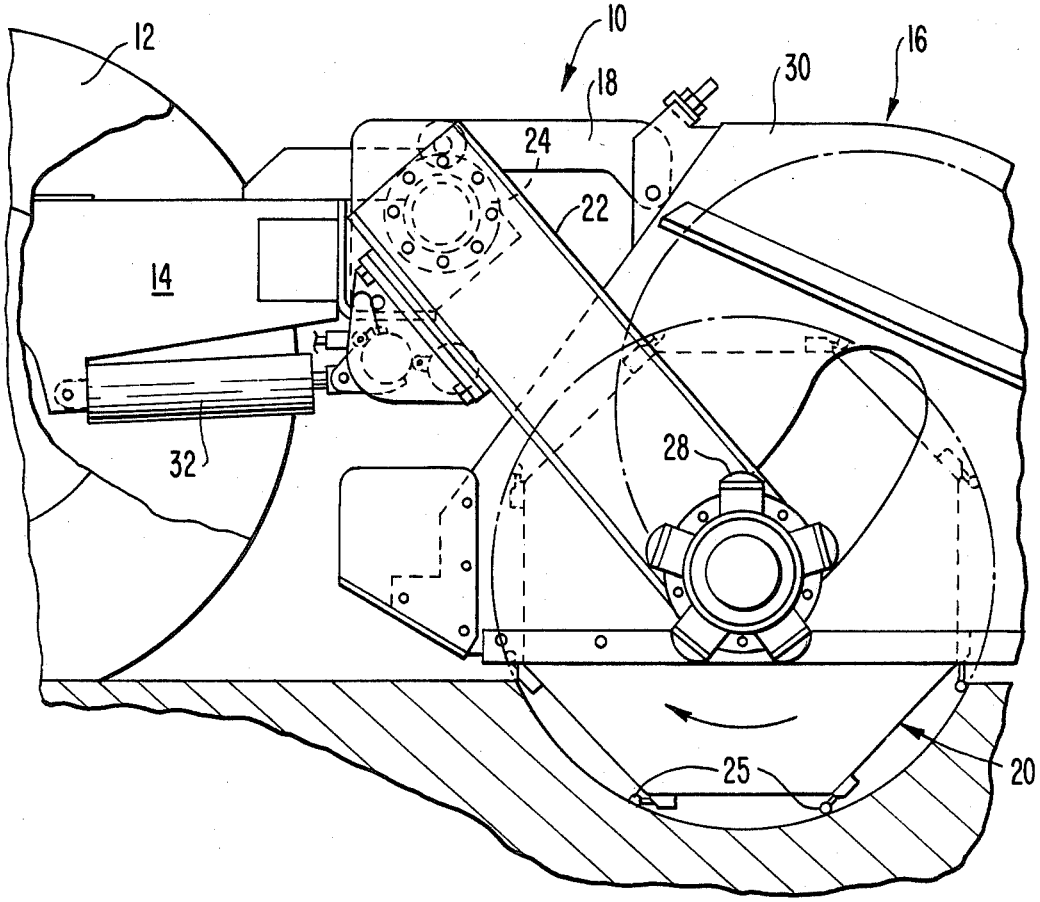
FIG. 1 is an enlarged partial side view of a road working machine having a rotor cutting a road surface.

FIG. 1 shows a typical self-propelled road working machine, designated generally by the reference numeral 10, having traction wheels 12 supporting a chassis 14 and a road working unit 16 located at the rear of the chassis 14 and connected thereto by a drawbar 18. The road working unit 16 includes a horizontally disposed rotor 20 which is mounted between a pair of spaced apart rearwardly extending lifting arms 22 (one of which is shown) connected to a horizontally extending cross-tube 24. The rotor 20 includes cutting teeth 25 and a rotor shaft 26 (FIG. 2), and is adapted to be rotated by, for example, low speed, high torque hydraulic motors 28 to cut generally up to 16 inches deep into a road or other surface. Typically, each end of the rotor shaft 26 is hollow and extends into a roller bearing (not shown) which is mounted in a cylindrical bearing housing (not shown) in turn secured by welding to one of the lifting arms 22. A different hydraulic motor or high speed hydraulic motor with a planetary gear box may alternatively be used, with a non-rotating flange attached to the arm 22 and a rotating flange attached to the rotor 20. A rotor hood 30 is supported on the drawbar 18 and surrounds the rotor 20 to contain material displaced by the rotor. The rotor 20 can be raised or lowered, for example, by hydraulic actuators 32. In operation, the road working machine 10 cuts a path equal to the width of the rotor 20, and the machine operator determines the cut path by keeping one end of the rotor 20 aligned with one edge of the desired path of cut.

Figure 3:
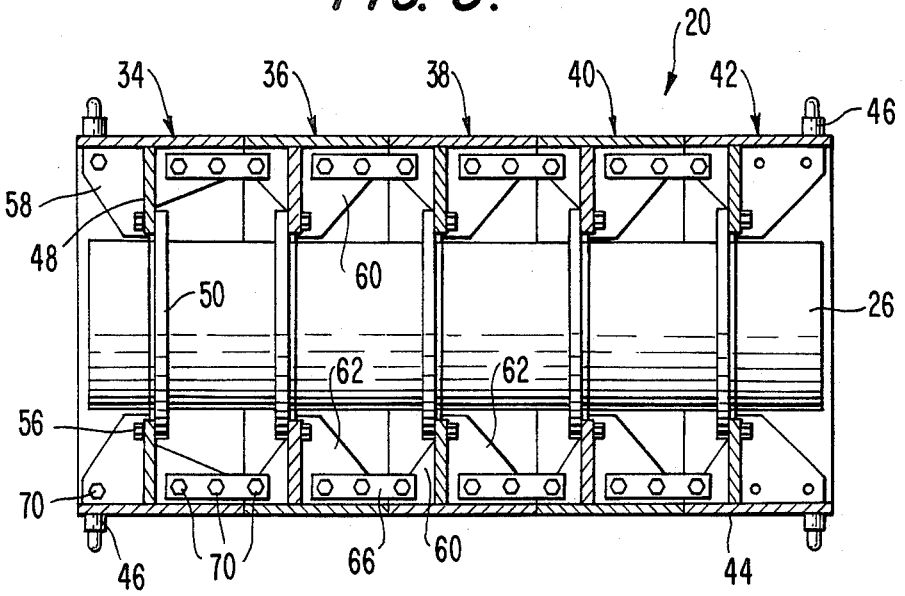
FIG. 3 is a cross section of the segmented rotor of FIG. 2.
Figure 2:
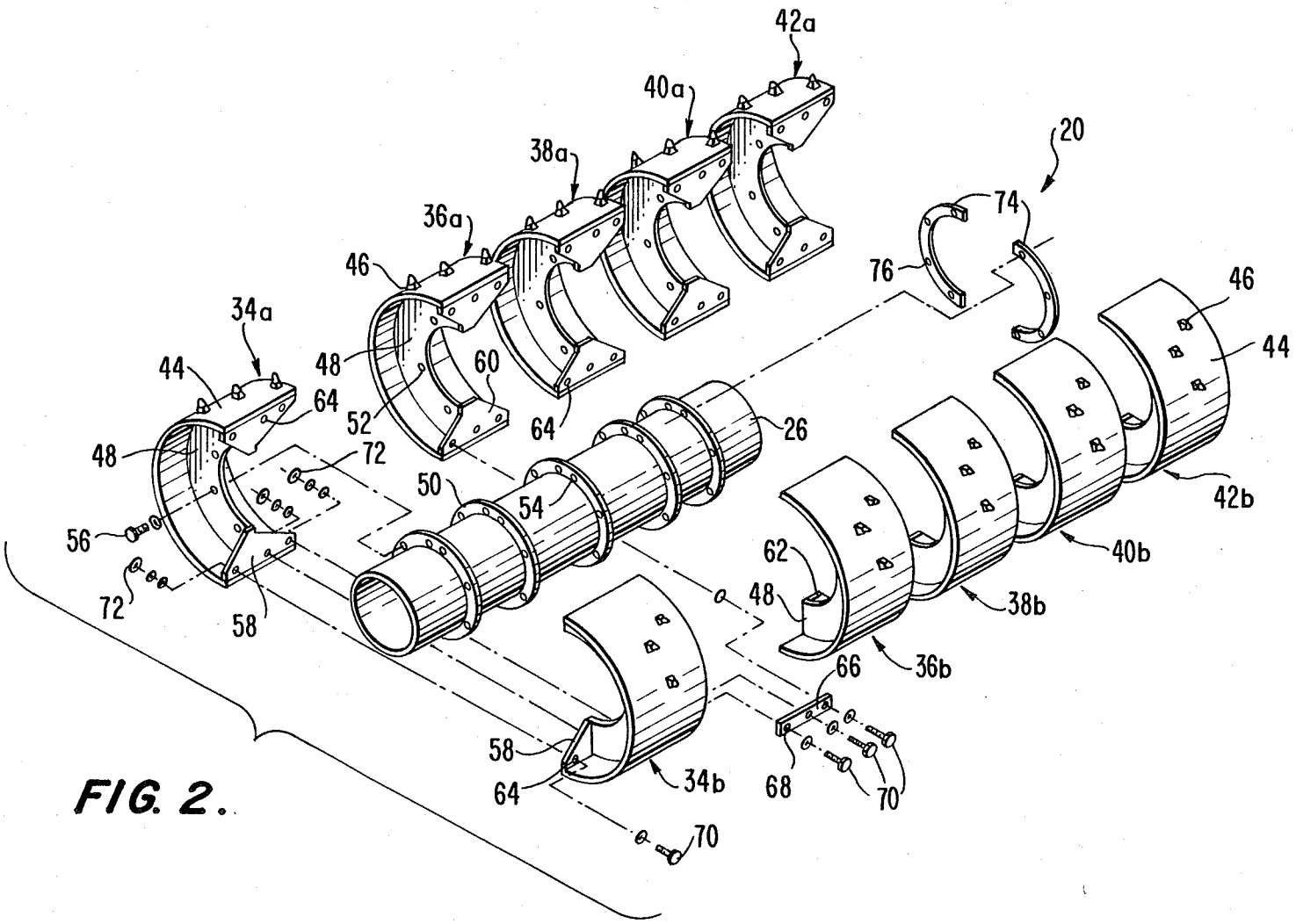
FIG. 2 is an exploded isometric view of a segmented rotor according to the present invention.

As can be seen from FIGS. 2 and 3, a first embodiment of the rotor 20 according to the present invention comprises a plurality of rotor segments 34, 36, 38, 40 and 42 each including a pair of rotor subsegments **34*a* and 34*b*, 36*a* and 36*b*, etc. Each of the rotor segments 34–42 defines a cylinder, and the rotor subsegments 34*a*–42*a* and 34*b*–42*b* are sectors of the cylinder. In the embodiment illustrated, the rotor subsegments are halves of the cylinders. Each segment half includes a semicylindrical shell 44 having cutters 46 mounted at preselected locations on the outer surface thereof and a semicircular head disc 48 secured to the inner surface thereof axially between the ends by, for example, welding. The cutters 46 can be removably mounted in holders secured to the rotor 20, such as in a knock in/knock out arrangement. The head discs 48 are removably attached to mounting flanges 50 fixed to the rotor shaft 26, the head discs 48 having a plurality of apertures 52 defining an annular pattern and the mounting flanges 50 having correspondingly spaced threaded openings 54 and machined mounting surfaces, whereby the apertures 52 can be aligned with the threaded openings 54, and screws 56 can be inserted to removably attach the head discs 48 to the mounting flanges 50 in a precise fit. Although the apertures 52 can only be seen on the rotor subsegments 34*a*–42*a* in FIG. 2, it is understood that they are also present in the head discs 48 of the rotor subsegments 34*b*–42*b*. The apertures 52 on the head discs 48 and the threaded openings 54 on the mounting flanges 50 are unevenly spaced so that the halves of the rotor segments 34–42 can be secured in only one circumferential orientation with respect to the rotor shaft 26. Bulkhead plates 58 of a first configuration are secured to the subsegments 34*a* and 34*b* at the ends of the head discs 48, bulkhead plates 60 of a second configuration are secured to the subsegments 36*a*–42*a*, and bulkhead plates of a third configuration are secured to the subsegments 36*b*–42*b*. Apertures 64 are provided in each of the bulkhead plates 58, 60 and 62 so that each rotor segment can be removably connected to adjacent rotor segments by connecting bars 66 having holes 68 in alignment with the apertures 64 in the bulkhead plates for receiving bolts 70 and nuts 72. All of the subsegments are identical except for the subsegments 34*a* and 34*b*, which comprise the rotor segment 34 at a base end of the rotor shaft 26, the segment which is in use regardless of the width of the rotor. The screws 56 removably attaching the head discs 48 of the segments 36–42 to the mounting flanges 50 and the bolts 70 and nuts 72 removably attaching each of the subsegments 36*b*–42*b* to its respective subsegment 36*a*–42*a* are accessible only from a side of segment distal to the base rotor segment 34. Therefore, rotor segments contiguous with the base rotor segment 34 can only be added in series in the direction from the base end of the rotor 20** to the distal end, and can be removed only in the direction from the distal end to the base end.

Thus, a rotor 20 of any width begins at the base end of the rotor shaft 26 and extends toward the distal end, so that the rotor 20 can be brought next to a curb in order to cut right up to the edge of a road. In the rotor segment 34 at the base end, there are three of the through apertures 64 in the bulkhead plates 58 by which one of the connecting bars 66 can be secured to the base rotor segment 34 and the subsegments **34*a* and 34*b* can be secured to one another. The aperture 64 closest to the base end of the rotor shaft 26 on each of the bulkhead plates 58 receives a bolt 70 and a nut 72 for securing the bulkhead plates 58 directly to one another. The other two apertures 64 on the bulkhead plates 58 are through holes with which two of three through holes 68 in the connecting bars 66 are aligned so that the connecting bars can be clamped between the bulkhead plates when bolts 70 are received in the aligned apertures 64 and the through holes 68 and are secured by nuts 72. The remaining through hole 68 on each connecting bar 66 is at an end of the connecting bar extending laterally for connection to the bulkhead plate 60 on the adjacent rotor segment 36. The contiguous nature of the segments 34–42 of the rotor 20** isolates the screws, nuts and bolts holding the rotor together from abrasion by the material being cut and prevents their heads from being rounded off, which would render disassembly of the rotor difficult or impossible.

The bulkhead plates 62 of the third configuration on each of the second subsegments **36*b*–42*b* extend only from the head discs 48 toward the distal end of each semicylindrical shell 44, thereby providing room for the distal end of the connecting bar 66 of each rotor segment to extend into alignment with an aperture 64 in the bulkhead plate 60 of a first rotor subsegment of an adjacent rotor segment so that one of the bolts 70 can be received to connect the connecting bar 66 to the bulkhead plate 60. The head discs 48 on the base rotor segment 34 are positioned on the base end side of the mounting flange 50 to which they are secured, so that the screws 56 are accessible from the base end. The head discs 48 of all the other rotor segments 36–42 are positioned on the sides of their respective mounting flanges 50 distal to the base end, so that the screws securing these head discs 48 to the mounting flanges 50 are all accessible as rotor segments are added in series beginning at the base end of the rotor 20** or removed in series beginning at the distal end.

The bulkhead plates 58 on the rotor subsegments 34*a* and 34*b* are configured slightly differently from the bulkhead plates 60 and 62 of the other rotor subsegments in order to account for the positioning of the head discs 48 of the subsegments 34*a* and 34*b* on the base side of the mounting flanges 50 rather than on the distal side. The completed assembly of head discs 48, mounting flanges 50, bulkhead plates 58, 60 and 62, and connecting bars 66 can be seen from FIG. 3. When fewer than the full number of rotor segments are used, protection rings, comprising discrete semi-circular elements 74 of steel or other hard material, are secured to the unoccupied rotor segment mounting flanges to protect the mounting flanges from wear by the material being cut. The semicircular elements 74 have a slightly larger outside diameter than the rotor mounting flanges 50 and apertures 76 for alignment with the threaded openings 54 in the rotor mounting flanges for attachment by screws 56, whereby the protection rings protect the machined mounting surfaces, threaded openings 54 and circumferential surfaces of the mounting flanges 50. Where the full number of rotor segments are used, as in FIGS. 2 and 3, no semicircular elements 74 are attached to the mounting flanges 50.

Figure 4:
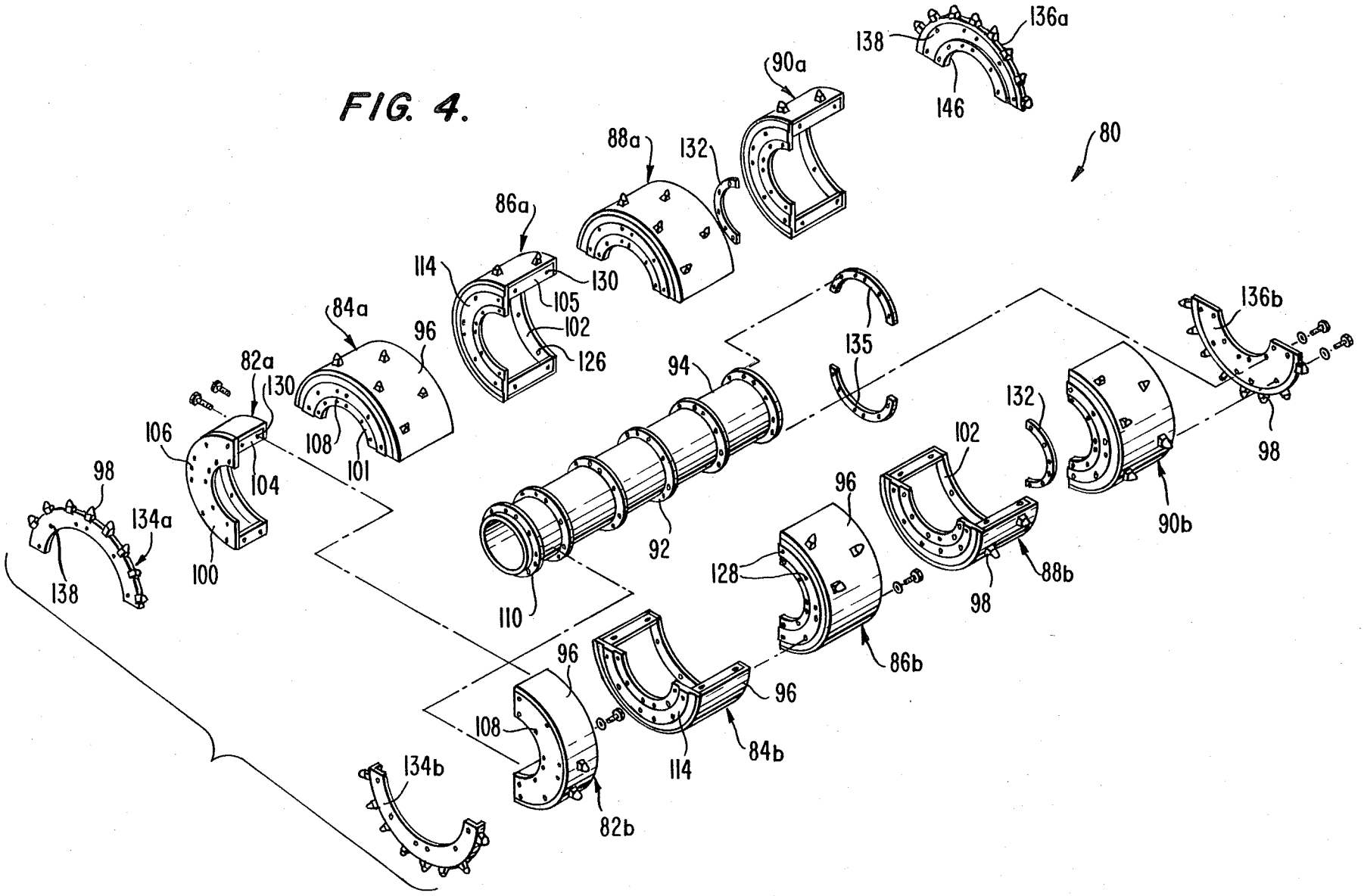
FIG. 4 is an exploded isometric view of another segmented rotor according to the present invention.
Figure 5:
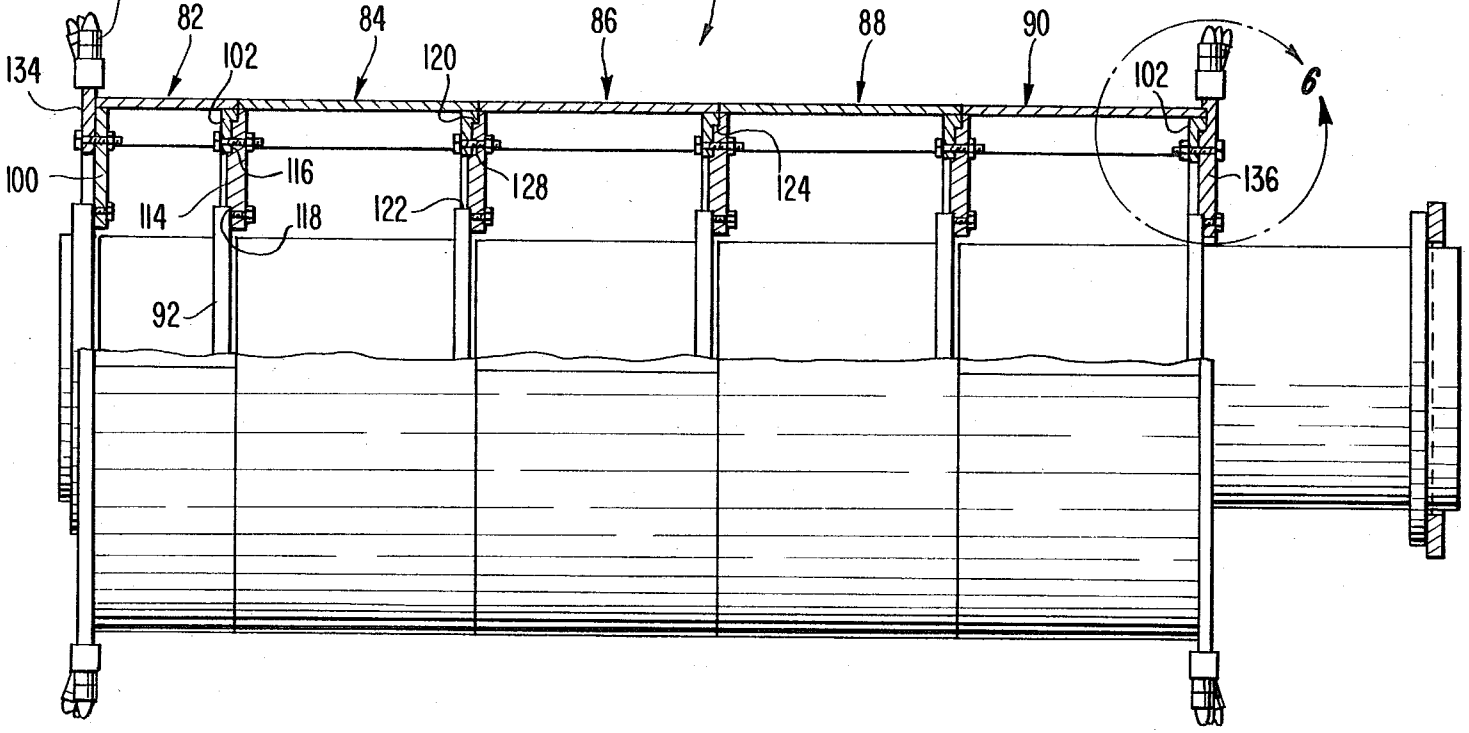
FIG. 5 is a front view, with parts in cross section, of the segmented rotor of FIG. 4.

As can be seen from FIGS. 4 and 5, another embodiment of the segmented rotor according to the present invention, which is designated generally by the reference numeral 80, provides for the direct connection of rotor segments to one another rather than requiring separate connecting elements, such as the connecting bars 66 employed with the embodiment of FIGS. 2 and 3. As in the first embodiment, rotor segments 82, 84, 86, 88 and 90 of the second embodiment comprise rotor subsegments 82*a*–90*a* and 82*b*–90*b*, or halves, which are secured to mounting flanges 92 on a rotor shaft 94. The rotor segment 82 is a unique, base segment, and the other rotor segments 84–90 are identical to one another. Each segment half includes a semicylindrical shell 96 having an outer surface to which removable cutters 98 are secured. Semicircular head discs 100 and 101 are secured to inner surfaces of the semicylindrical shells 96, at the end of each semicylindrical shell adjacent the base end of the rotor shaft 94, rather than being mounted between the ends of the shell, as in the embodiment of FIGS. 2 and 3. An additional semicircular element, a flange disc 102, is secured to the inner surface of each semicylindrical shell 96 at the end of the shell distal to the base end of the rotor shaft 94. Bulkhead plates 104 are secured to the ends of the semicylindrical shells 96, the head discs 100, and the flange discs 102 in the rotor segment 82, and both the head discs 100 and flange discs 102 are machined. Bulkhead plates 105, which are secured to the rotor segments 84–90, differ from the bulkhead plates 104 only in their size, since the rotor segment 82 is narrower than the rotor segments 84–90 in the embodiment illustrated in FIGS. 4 and 5. The head discs 100 have two sets of openings, one set of threaded apertures 106 spaced along an outer arc of the head disc in an annular pattern and one set of through openings 108 defining an annular pattern along an inner arc. The through openings 108 along the inner arc are spaced for alignment with a corresponding pattern of spaced threaded apertures 110 in one of the mounting flanges 92 so that the base rotor segment 82 can be secured to the mounting flange. In this embodiment, the head discs 100 of the base rotor segment 82 are positioned on the distal side of their mounting flange 92, as are the head discs 101 of all of the other rotor segments.

The head discs 100 of the base rotor segment 82 have planar surfaces, whereas the head discs 101 of all of the other rotor segments 84–90 each have an arcuate male pilot portion 114 extending toward the base end of the rotor shaft 94 and the flange disc 102 of the adjacent rotor segment. As can be seen from FIG. 5, the flange discs 102 of all of the rotor segments, including the base rotor segment 82, have an arcuate female pilot portion 116 for mating with the male pilot portion 114 of the adjacent head disc. The male pilot portions 114 define annular shoulders 118 and 120 for engaging, respectively, a circumferential surface 122 of the rotor mounting flange 92 and an annular shoulder 124 on the female pilot portion 116. The engagement of the annular shoulders 118 and 120 with the mounting flanges 92 and the annular shoulders 124 provides radial support for the distal end of each of the rotor segments 82–88, from the rotor shaft 94 all the way up to the semicircular shells 96. Similar support for the rotor segment 90 is provided by a segmented end ring to be described hereinafter. Each flange disc 102 has a set of threaded apertures 126 defined in the female pilot portion 116 and spaced for alignment with spaced openings 128 along an outer arc of the head disc 101 of the adjacent rotor segment, so that screws can be inserted from the distal side of the head disc. Each bulkhead plate 104 and 105 has a pair of spaced apertures 130 for direct connection by suitable fasteners to the bulkhead plate on the opposite rotor half, or subsegment, as is illustrated in FIG. 4.

The joints between subsegments for each rotor segment 82–90 are spaced circumferentially from the joints in the adjacent rotor segments by 90 degrees. This rotor segment arrangement provides greater rigidity to the rotary drum which the segments comprise and minimizes the number of cutting teeth which engage the road surface at any given moment of time, since the pattern of cutting teeth on each rotor subsegment is the same, except for the narrower subsegments 82*a* and 82*b*. The threaded apertures 110 in the annular pattern in the rotor segment mounting flanges 92 and the through openings 108 in the annular pattern on the inner arc on the head discs 100 and 101 are unevenly spaced along their arcs, with the annular pattern repeating every 90 degrees. Thus, each rotor subsegment can only be positioned circumferentially in one of four positions, each position being spaced from the next possible position by 90 degrees. The machine tolerances for the segmented rotor 80 are such that, in the worst case, one shim, provided in shim sections 132, may be required at the mounting flange 110 at the distal end of the rotor shaft 94 to make up for manufacturing tolerances. Protection rings comprising semicircular elements 135 can be attached to mounting flanges 92 unoccupied by rotor segments.

Figure 6:
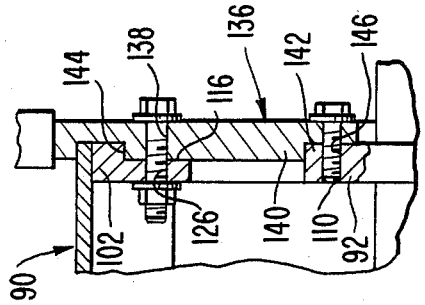
FIG. 6 is an enlarged view of the area encircled by the arrow 6 in FIG. 5.

Split end rings 134 and 136, provided for attachment to the rotor segments 82 and 90, respectively, at each end of the rotor 80, comprise end ring sections 134*a*, 134*b*, 136*a* and 136*b*, and contain a high concentration of cutters 98 for edging purposes. The end rings 134 and 136 contain a plurality of arcuately spaced openings 138 for alignment, respectively, with the threaded apertures 126 along the outer arc of the head disc 100, at the base end of the rotor 80, and with the arcuately spaced threaded apertures 126 in the flange disc 102 of the rotor segment 90 at the distal end of the rotor. As can best be seen from the enlarged cross section of FIG. 6, the openings 138 in the end ring 136 are defined in an arcuate male pilot portion 140 which defines annular shoulders 142 and 144 and cooperates with the female pilot portion 116 on the flange disc 102 of the rotor segment 90 in the same way that the male pilot portions 114 of the head discs 101 cooperate with the female pilot portions 116 of all of the other rotor segments 82–88. A plurality of openings 146 are provided along an inner arc of the split end ring 136 for alignment with the threaded apertures 110 in one of the mounting flanges 92. The splits or joints in the split end rings 134 and 136 are oriented at 90 degrees to the joints of the rotor segments 82 and 90 to which they are attached, for greater rotor strength.

The cutting teeth on the split end ring 134 at the base end of the rotor 80 are canted toward the base end for edge cutting along that end, and the cutting teeth on the split end ring 136 at the distal end are canted toward the distal end for similar edge cutting. Since side cutting forces create more wear, the end teeth and their holder wear out faster than the rest of the teeth and rotor. The split end ring 134 permits quick replacement of such teeth, by its removal and replacement with a new ring.

Figure 7:
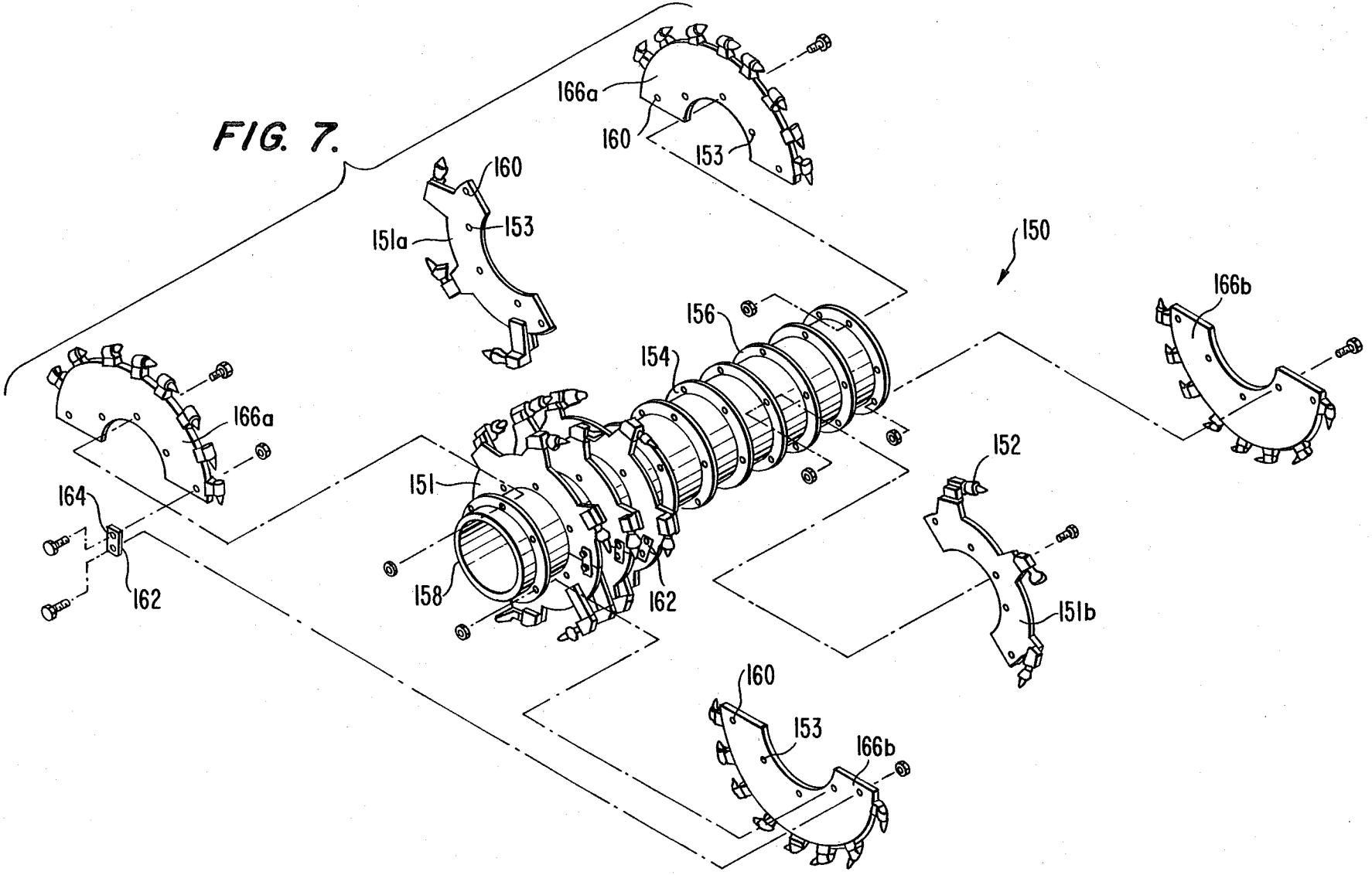
FIG. 7 is an exploded isometric view of still another segmented rotor according to the present invention.

In a third embodiment according to the present invention, as can be seen from FIG. 7, the rotor 150 comprises a plurality of rotor segments in the form of split tine plates 151, each of which carries a plurality of cutters 152. Tine plate sections **151*a* and 151*b* each contain an arcuate array of apertures 153 for alignment with apertures 154 in mounting flanges 156 on a rotor shaft 158, and additional apertures 160 to provide connection to the mating tine plate sections through the use of connecting bars 162 and appropriate fasteners. The connecting bars 162 define openings 164 properly positioned for registration with the apertures 160. End tine plates 166, comprising tine plate sections 166*a* and 166*b*, have a higher concentration of cutters 152 and the cutters are angled laterally outwardly of the rotor to provide for edge cutting and rotor clearance. The tine plates 166, like the tine plates 151, define the arcuate array of apertures 153 and additional apertures 160. The tine plates 151 are oriented such that the cutters 152 on each tine plate are slightly ahead of the cutters on one adjacent tine plate 151, with respect to the direction of rotation of the rotor 150, and slightly behind the cutters on the other adjacent tine plate 151, so that the rows of cutters 152** define a helix across the rotor. Such a pattern minimizes the number of cutting teeth in engagement with the road surface at any moment.

Figure 8:
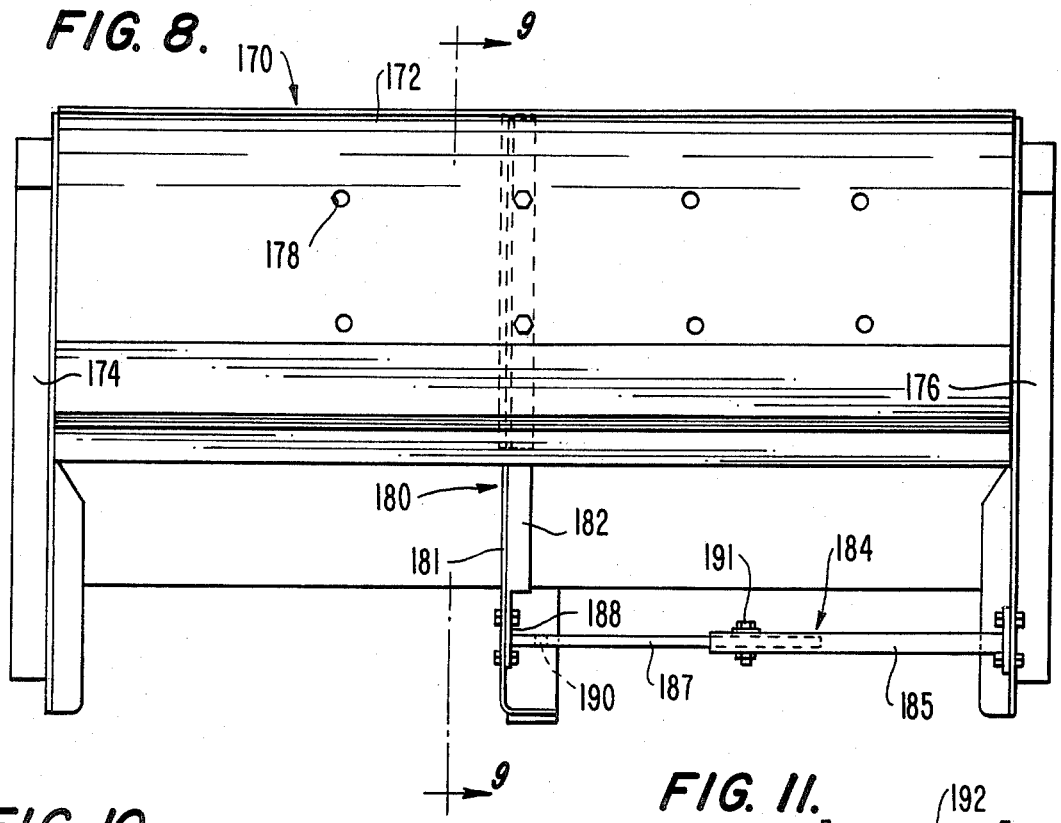
FIG. 8 is a side view of a cover having an adjustable baffle for the rotors according to the present invention.
Figure 10:
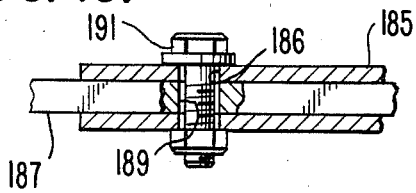
FIG. 10 is an enlarged cross section of a portion of a telescoping brace of the cover of FIG. 9.
Figure 9:
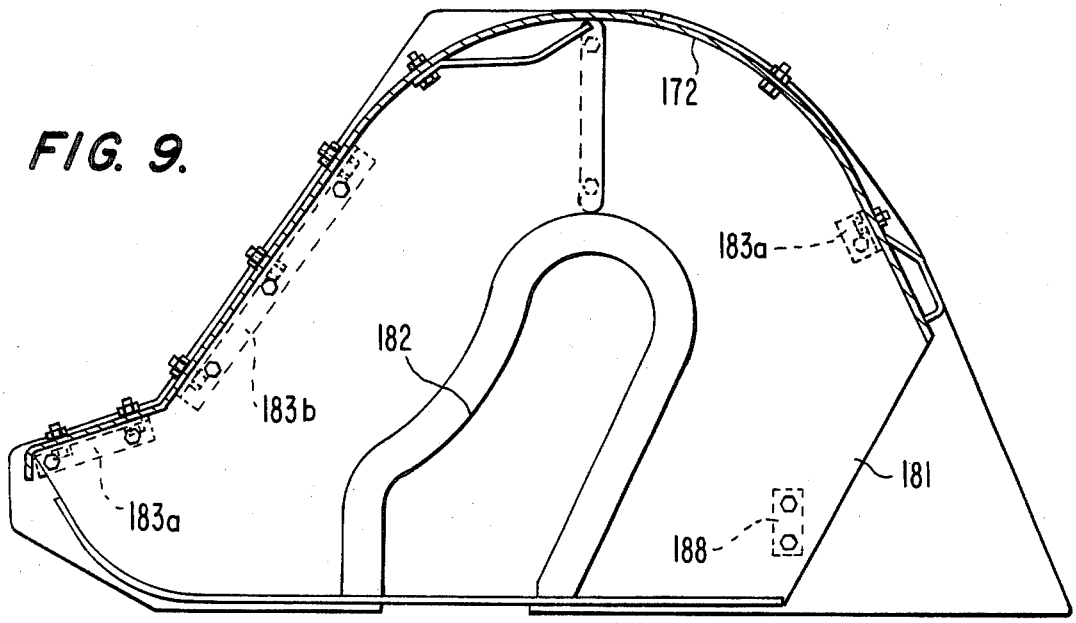
FIG. 9 is a cross section taken along the line 9—9 in FIG. 8.

As can be seen from FIGS. 8 and 9, a cover 170 for the segment rotor includes a curved top portion 172 and first and second end portions 174 and 176. A plurality of equally spaced sets of apertures 178 are provided in the curved top portion 172 to permit registration with apertures in an adjustable baffle 180, thereby allowing the baffle 180 to be secured in selected positions across the width of the cover 170 to correspond to the width of the segmented rotor being employed at a particular time. Note that, although only two apertures 178 of each set are visible in FIG. 8 on the front of the curved top portion 172, additional apertures of the same set are defined in the rear of the curved top portion 172, in substantially the same vertical plane as the two visible apertures 178, as can be determined by the positions of the fasteners connecting the angle elements **183*a* and 183*b* to the curved top portion 172 on the left side of FIG. 9. The adjustable baffle 180, which defines a partition to confine loose material under the rotor segments, includes a planar body portion 181 defining a slot 182 to receive the transversely mounted rotor and to accommodate its arcuate up and down movement. Angle elements 183*a*, 183*b* and 183*c* are fixed to several places around the periphery of the planar body portion 181, the angle elements defining flanges containing the apertures of the adjustable baffle 180. A telescoping brace 184 is provided between an unsecured portion of the adjustable baffle 180 and the end 176 of the cover 170 adjacent to the distal end of the segmented rotor to provide additional support and rigidity for the baffle 180. The telescoping brace 184 includes an outer tubular member 185 having one end secured to the end 176 of the cover 170 and a through opening 186 defined adjacent the opposite, unsecured end in a direction transverse to the length of the outer tubular member. The telescoping brace 184 further includes an inner elongate member 187 slidingly received in the outer tubular member 185, the inner elongate member 187 having an end plate 188 for attachment to the adjustable baffle 180. The inner elongate member 187 defines near its unattached end a first transverse opening 189 and near its attached end a second transverse opening 190, the spacing between the first and second transverse openings being equal to the distance between the sets of apertures 178 in the cover 170. Either one of the transverse openings 189 or 190 in the inner elongate member 187 is registrable with the transverse opening 186 of the outer tubular member 185 to receive a bolt 191 for maintaining the inner elongate member 187 in fixed relationship with the outer tubular member, as can best be seen from FIG. 10**.

Figure 11:
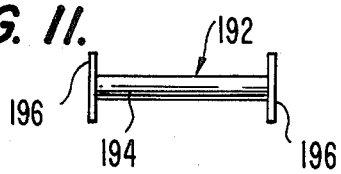
FIG. 11 is a side view of a brace element employable with the cover of FIG. 8.

In its telescoped, or collapsed, position, the telescoping brace 184 reinforces the adjustable baffle 180 in a first position with respect to the rotor cover 170, a position in which the adjustable baffle 180 is immediately adjacent the distal end of a rotor having a certain number of rotor segments. In its extended position, the telescoping brace 184 reinforces the adjustable baffle 180 in a second position, in which the adjustable baffle 180 is immediately adjacent the distal end of a rotor having one fewer rotor segments than the rotor with which the telescoping brace is used in its collapsed position. The adjustability of the adjustable baffle 180 is enhanced by a brace element 192, shown in FIG. 11, of a fixed length equal to the distance between the sets of apertures 178 in the cover 170. The brace element 192 has a body portion 194 and a flange 196 at each end of the body portion 194. One of the flanges 196 can be secured to the flange 188 on the inner elongate member 187 when the telescoping brace 184 is in its extended position to define an even longer bracing device for the adjustable baffle 180. Such a bracing device secures the adjustable baffle in a position still closer to the base end of the rotor, immediately adjacent the distal end of a rotor employing one fewer rotor segments than the rotor with which the extended telescoping brace 184 alone is used. In addition, the brace element 192 can be installed directly between the end 176 of the cover 170 and the adjustable baffle 180, without the telescoping brace 184, to space the adjustable baffle 180 just one rotor segment length short of a rotor using all of its rotor segments.

Although particular embodiments have been specifically described herein and illustrated in the drawings, it is contemplated by the applicant that various changes can be made without departure from the present invention. For example, although the rotors described herein employ five rotor segments to comprise a full rotor, full rotors using other numbers of rotor segments of varying widths can be used. In addition, the types of cutting teeth used and their arrangement on the rotor can be different from those shown. Accordingly, it is intended that the foregoing description is illustrative only, not limiting, and that the true spirit and scope of the present invention will be determined by the appended claims.

I claim:

1. In a road or soil working machine having a rotor of predetermined width and cutting teeth mounted on the rotor for cutting a strip of corresponding width in a surface, the improvement comprising:

the rotor including a shaft, a plurality of segments each having a circular shape and defining together a width equal to said predetermined width, and a plurality of said cutting teeth mounted on each of said segments, said segments including a plurality of subsegments each defining a sector of said circular shape, said rotor further including first means for removably attaching each said subsegment to said shaft, second means for removably attaching each said subsegment to the other subsegment of the same segment, whereby any number of segments can be added to and removed from said shaft without disconnecting said shaft from said road working machine, in order to define a rotor having a width different from said predetermined width, and third means for removably attaching each said rotor segment to adjacent rotor segments.

2. The road working machine of claim 1, wherein said shaft includes a plurality of radially extending mounting flanges, and said first means comprises means for removably attaching said subsegments to said mounting flanges.

3. The road working machine of claim 2, wherein said first means and said second means for removably attaching comprise threaded fasteners.

4. The road working machine of claim 1, wherein said third means for removably attaching comprises connecting elements and threaded fasteners for securing each said connecting element to each of two adjacent rotor segments.

5. The road working machine of claim 1, wherein one of said rotor segments is a base segment secured at one end of said shaft, said base segment being included in rotors of any selected width, and said first means for removably attaching each said subsegment to said shaft and said second means for removably attaching each said subsegment to the other subsegment of the same segment are accessible only from a side of each said segment distal to said base segment, whereby rotor segments other than said base segment are added to said shaft in series beginning adjacent said base segment and are removed in series from the end of the shaft distal to said base segment.

6. The road working machine of claim 1, wherein said cutting teeth are removably secured to said rotor segments.

7. The road working machine of claim 1, wherein the subsegments of each rotor segment define a joint with one another, the joint of each rotor segment being circumferentially spaced from the joints of adjacent rotor segments by 90°.

8. The road working machine of claim 7, wherein each mounting flange defines an annular pattern of unevenly spaced apertures, said annular pattern repeating at 90° intervals, and a corresponding pattern of apertures on each of said rotor subsegments in alignment with said annular pattern on each said mounting flange, said threaded fasteners being received in said aligned apertures to secure said rotor segments in discrete positions circumferentially offset from one another by 90°.

9. The road working machine of claim 1, further comprising a cover mounted over said rotor and a baffle being adjustably secured to said cover, said baffle depending from said cover and defining a partition between an end rotor segment and the corresponding end of the rotor to confine loose material to under the rotor segments.

10. The road working machine of claim 9, wherein said cover includes a plurality of sets of openings spaced axially with respect to said rotor and said baffle includes a set of openings corresponding to any one of the sets of openings in said cover, said cover further including threaded fasteners receivable in said any one set of the openings in the cover and the corresponding set of openings in said baffle to secure said baffle in any one of a plurality of positions spaced axially along said rotor.

11. The road working machine of claim 10, wherein said cover further includes end walls and an adjustable brace extending between one of said endwalls and said baffle.

12. In a road or soil working machine having a rotor of predetermined width and cutting teeth mounted on the rotor for cutting a strip of corresponding width in a surface, the improvement comprising:

the rotor including a shaft, a plurality of segments each having a circular shape and defining together a width equal to said predetermined width, and a plurality of said cutting teeth mounted on each of said segments, said segments including a plurality of subsegments each defining a sector of said circular shape, said rotor further including first means for removably attaching each said subsegment to said shaft, and second means for removably attaching each said subsegment to the other subsegment of the same segment, whereby any number of segments can be added to and removed from said shaft without disconnecting said shaft from said road working machine, in order to define a rotor having a width different from said predetermined width;

said shaft including a plurality of radially extending mounting flanges, and said first means comprising means for removably attaching said subsegments to said mounting flanges, and the road working machine further comprising protection rings removably attached to the mounting flanges to which rotor segments are not attached, said mounting flanges defining a plurality of openings for receiving threaded fasteners, and said protection rings defining a plurality of openings in alignment with the openings of the mounting flanges, and threaded fasteners extending through said aligned openings to secure said protection rings to said mounting flanges, said protection rings extending radially beyond said mounting flanges and comprising a plurality of discrete elements each defining a sector of said protection ring.

13. The road working machine of claim 12, further comprising third means for removably attaching each said rotor segment to adjacent rotor segments.

14. In a road or soil working machine having a rotor of predeter:mined width and cutting teeth mounted on the rotor for cutting a strip of corresponding width in a surface, the improvement comprising:

the rotor including a shaft, a plurality of segments each having a circular shape and defining together a width equal to said predetermined width, and a plurality of said cutting teeth mounted on each of said segments, said segments including a plurality of subsegments each defining a sector of said circular shape, said rotor further including first means for removably attaching each said subsegment to said shaft, and second means for removably attaching each said subsegment to the other subsegment of the same segment, whereby any number of segments can be added to and removed from said shaft without disconnecting said shaft from said road working machine, in order to define a rotor having a width different from said predetermined width;

one of said rotor segments being a base segment secured at one end of said shaft, said base segment being included in rotors of any selected width, and said first means for removably attaching each said subsegment to said shaft and said second means for removably attaching each said subsegment to the other subsegment of the same segment being accessible only from a side of each said segment distal to said base segment, whereby rotor segments other than said base segment are added to said shaft in series beginning adjacent said base segment and are removed in series from the end of the shaft distal to said base segment;

each subsegment comprising a semicylindrical shell having an inner surface and an outer surface, a semicircular head disc secured to said inner surface, and a bulkhead plate secured at each end of said semicylindrical shell, each said bulkhead plate abutting a mating bulkhead plate on the other subsegment, said abutting bulkhead plates having aligned apertures, and threaded fasteners received in said aligned apertures to secure said subsegments to one another.

15. The road working machine of claim 14, wherein said rotor segments are cylindrical, said rotor segments being contiguous with one another to define a drum.

16. The road working machine of claim 15, wherein said first means and said second means comprise threaded fasteners.

17. The road working machine of claim 14, wherein said head disc is positioned between the base end and the distal end of its rotor segment.

18. The road working machine of claim 14, wherein said head disc is positioned at the base end of its rotor segment, and a flange disc is secured to the inner surface of each semicylindrical shell at the distal end of the rotor segment, said head disc having apertures spaced along an arc and said flange discs having corresponding apertures spaced along an arc and aligned with said apertures in said head disc, and threaded fasteners received in said aligned apertures for securing the flange discs of each rotor segment directly to the head disc of the adjacent rotor segment.

19. The road working machine of claim 18, wherein the flange disc of each of the rotor segments defines an arcuate female pilot portion and the head disc of each of said rotor segments lying beyond the distal end of the base segment defines an arcuate male pilot portion mating with said arcuate female pilot portion of the adjacent rotor segment, whereby radial support is provided at both ends of the rotor segments.

20. In a road or soil working machine having a rotor of predetermined width and cutting teeth mounted on the rotor for cutting a strip of corresponding width in a surface, the improvement comprising:

the rotor incuding a shaft, a purality of segments each having a circular shape and defining together a width equal to said predetermined width, and a plurality of said cutting teeth mounted on each of said segments, said segments including a plurality of subsegments each defining a sector of said circular shape, said rotor further including first means for removably attaching each said subsegment to said shaft, and second means for removably attaching each said subsegment to the other subsegment of the same segment, whereby any number of segments can be added to and removed from said shaft without disconnecting said shaft from said road working machine, in order to define a rotor having a width different from said predetermined width;

the road working machine further comprising end rings secured to said rotor at the axial ends of the rotor in abutment with said rotor segments, said end rings supporting a plurality of cutting teeth, said end ring cutting teeth being positioned circumferentially more closely to one another than the cutting teeth on the rotor segments for more efficient edge cutting.

21. The road working machine of claim 20, wherein each end ring comprises a pair of semicircular sections.

22. The road working machine of claim 20, wherein said end rings are secured to said rotor segments.

* * * * *